US007708129B1

(12) United States Patent
Chang

(10) Patent No.: US 7,708,129 B1
(45) **Date of Patent: *May 4, 2010**

(54) MULTIPLE COIN ACTUATION MECHANISM HAVING PIVOTAL LATCH PREVENTING COIN REMOVAL FROM CARRIER WHEEL RECESS

(76) Inventor: Kil Jae Chang, T.PICo. Korea Co., Ltd., 321-37 Suksu, 2 Dong, Anyang City, Kyungkido (KR)

( * ) Notice: Subject to any disclaimer, the term of this patent is extended or adjusted under 35 U.S.C. 154(b) by 32 days.

This patent is subject to a terminal disclaimer.

(21) Appl. No.: 12/150,688

(22) Filed: Apr. 29, 2008

Related U.S. Application Data

(60) Provisional application No. 61/062,721, filed on Jan. 29, 2008.

(51) Int. Cl.

| | |
|---|---|
| ***G07F 5/02*** | (2006.01) |
| ***G07F 5/10*** | (2006.01) |
| ***G07F 5/00*** | (2006.01) |
| ***G07F 11/00*** | (2006.01) |
| ***G07F 13/00*** | (2006.01) |
| ***G07F 15/00*** | (2006.01) |
| ***G07F 17/00*** | (2006.01) |

(52) U.S. Cl. ..... 194/254; 194/232; 194/235; 194/236; 194/335; 194/338

(58) Field of Classification Search ..... 194/229, 194/232–237, 253, 254, 292, 334, 335
See application file for complete search history.

(56) References Cited

U.S. PATENT DOCUMENTS

| | | | | |
|---|---|---|---|---|
| 5,657,848 | A | 8/1997 | Schwarzli | |
| 5,924,542 | A | 7/1999 | Schwarzli | |
| 7,222,711 | B2 * | 5/2007 | Chang | 194/254 |

* cited by examiner

*Primary Examiner*—Jeffrey A Shapiro
(74) *Attorney, Agent, or Firm*—John R. Flanagan

(57) ABSTRACT

A multiple coin actuation mechanism has a latch biased to an inward home position with its inner end extending through an upstream side of a first coin slot of a stationary front cover plate toward a rotatable carrier wheel and generally alongside an unobstructed path for insertion of a first coin through the first coin slot into a first coin recess of the carrier wheel. The latch is pivotally yieldably movable away from the carrier wheel due to engagement with a second coin in a second coin recess in the rotatable carrier wheel, as the second coin is brought into alignment with the first coin slot, to allow the second coin to pass under the latch while the latch remains in contact with the second coin, preventing its removal from the second coin recess outwardly through the first coin slot, as the carrier wheel rotates past the first coin slot.

6 Claims, 3 Drawing Sheets

MULTIPLE COIN ACTUATION MECHANISM HAVING PIVOTAL LATCH PREVENTING COIN REMOVAL FROM CARRIER WHEEL RECESS

This patent application claims benefit of U.S. provisional application No. 61/062,721 filed Jan. 29, 2008.

BACKGROUND OF THE INVENTION

The present invention generally relates to vending machines and, more particularly, is concerned with a multiple coin actuation mechanism having a pivotal latch preventing coin removal from a carrier wheel recess.

U.S. Pat. Nos. 5,657,848 and 5,924,542 to Schwarzli disclose a prior art multiple coin actuation mechanism for a vending machine. The coin actuation mechanism has a front cover plate with first and second coin slots, a rotatable coin carrier wheel with first and second coin recesses angularly spaced apart on one face of the carrier wheel and aligned with the first and second coin slots of the cover plate when the carrier wheel is in a home position for the user to deposit a coin into each of the coin recesses, a rear retainer plate overlying the carrier wheel and fixedly attached to the front cover plate, and a rocker bar fixedly mounted on the rear retainer plate and having an end stop which normally extends through a hole in the rear retainer plate to adjacent a slot on the cover plate but not extended from the slot so as to intersect with the path of any coin moved into or removed from the first coin slot of the front cover plate which blocks movement or removal of the coin. When the carrier wheel is turned a cam on a ratchet wheel, which rotates with the carrier wheel, engages the rocker bar and causes it to deflect so as to project its end stop through the slot on the cover plate and across the coin path thereby blocking removal of the coin from the second coin recess of the carrier wheel through the first coin slot of the front cover plate. This action of the rocker bar and its end stop is synchronized by the cam to only occur when the coin in the second coin recess is aligned with the first coin slot. At all other times the rocker bar is undeflected and thus its end stop is withdrawn from extension through the slot. However, a problem with this design in that the use of the rocker bar coin blocking device increases the complexity and cost of the design over that of the conventional prior art coin actuation mechanisms.

U.S. Pat. No. 7,222,711 to Chang, the inventor herein, seeks to avoid the problem of the cited Schwarzli patents by employing a multiple coin actuation mechanism design that introduces a minimum of additions or modifications thereto. This patent employs a pivotal coin removal blocking latch and provides an edge notch defined adjacent to one side of the first coin recess in the carrier wheel which allows initial insertion of the first coin through the first coin slot into the first coin recess while preventing removal of the second coin from the second coin recess through the first coin slot when the carrier wheel is turned sufficiently to align the second coin recess with the first coin slot. However, the latch is normally in an outer initial home position in which it extends across the path movement of first coin insertion into the first coin slot. Thus, the latch will be contacted by the first coin and must be deflected out of the way by the first coin in order to achieve insertion of the first coin through the first coin slot into the first coin recess. Frequently, users inserting the first coin will think the latch is an obstruction that needs to be dealt with and some users may damage the machine in attempting to force the coin against the latch.

Consequently, the approach of neither of these above cited patents seems to provide the optimum solution for the problem at hand with respect to the general type of vending machine multiple coin actuation mechanism described above. Therefore, a need still exists for an approach which will provide a solution to the aforementioned problem in the prior art without introducing any new problems in place thereof.

SUMMARY OF THE INVENTION

The present invention provides a vending machine coin actuation mechanism and method designed to satisfy the aforementioned need. The approach of the present invention provides for the positioning and operation of a coin removal blocking latch that offers no obstruction to the first coin as it is inserted through the first coin slot into the first coin recess on the carrier wheel. Also, rather than blocking the first coin slot as the second coin recess becomes aligned with the first coin slot, the latch is biased toward the carrier wheel so as to yieldably ride over the second coin while still engaging and pressing against the second coin so as to retain it in the second coin recess as the rotating carrier wheel approaches and passes the first coin slot. As the second coin recess passes the first coin slot the latch remains in alignment with the second coin recess so as to prevents removal of the second coin from the second coin recess on the carrier wheel. Hence, the latch does not actually directly block access to the first coin slot but instead prevents removal of the second coin from the second coin recess on the carrier wheel.

In the present invention, the latch in an inner home position is disposed alongside the path of insertion the first coin such that there is no interfering-type contact of the latch with the first coin as the latter is inserted through the first coin slot into the first coin recess of the coin carrier wheel. The user inserting the first coin will not even realize the latch is present since the latch makes no interfering-type contact with the coin. Thus, a user is not apt to cause any damage to the machine in reaction to non-existent latch interference. The change in the action of a spring upon the latch, from that utilized in the prior art actuation mechanism, is to one that now biases movement of the latch such that users no longer perceive the latch as a barrier or interference to insertion of the coin. This change in the perception of users inserting the coin is the intended outcome of the modification.

Accordingly, the present invention is directed to a multiple coin actuation mechanism for a vending machine. The actuation mechanism includes: (a) a front cover plate adapted to fixedly attach to a vending machine, the front cover plate having a peripheral portion and first and second coin slots defined in and open at the peripheral portion at locations angularly spaced apart from one another; (b) a carrier wheel mounted for rotation in a predetermined direction relative to the front cover plate and having a front side facing toward the front cover plate and a rear side facing away from the front cover plate, the carrier wheel also having a peripheral edge and first and second coin recesses defined on the rear side of the carrier wheel at positions angularly spaced apart from one another and open at the peripheral edge of the carrier wheel for alignment with the first and second coin slots of the cover plate when the carrier wheel is in an initial home position at which a user can initially deposit first and second coins into the first and second coin recesses through the first and second coin slots, the carrier wheel being rotatable from the initial home position in the predetermined direction past a final coin dispensing position before returning to the initial home position upon completion of a dispensing cycle of operation of the coin actuation mechanism; (c) a rear retainer plate fixedly attached to the front cover plate and at least partially overlying the carrier wheel at the rear side thereof to assist retention of the first and second coins in the first and second coin recesses of the carrier wheel as the carrier wheel is rotated in the predetermined direction through the dispensing cycle of operation; and (d) means for allowing unobstructed insertion of the first coin through the first coin slot and into the first coin recess, the means including a latch biased to an inward home position in which an inner end of the latch extends through an upstream side of the first coin slot of the front cover plate, relative to the predetermined direction of rotation of the carrier wheel, generally alongside a path for insertion of the first coin through the first coin slot and into the first coin recess of the carrier wheel for allowing the unobstructed insertion of the first coin through the first coin slot into the first coin recess, the latch also pivotally yieldably movable away from the inward home position toward the first coin slot due to engagement with the second coin as the second coin recess of the carrier wheel is brought into alignment with the first coin slot of the front cover plate to allow the second coin in the second coin recess of the carrier wheel to pass under the latch and the latch to ride over the second coin while the latch remains in contact with the second coin and prevents removal of the second coin from the second coin recess of the carrier wheel as the carrier wheel is rotated in the predetermined direction through the complete dispensing cycle that results in the deposited first and second coins successively exiting from the carrier wheel at the discharge location.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
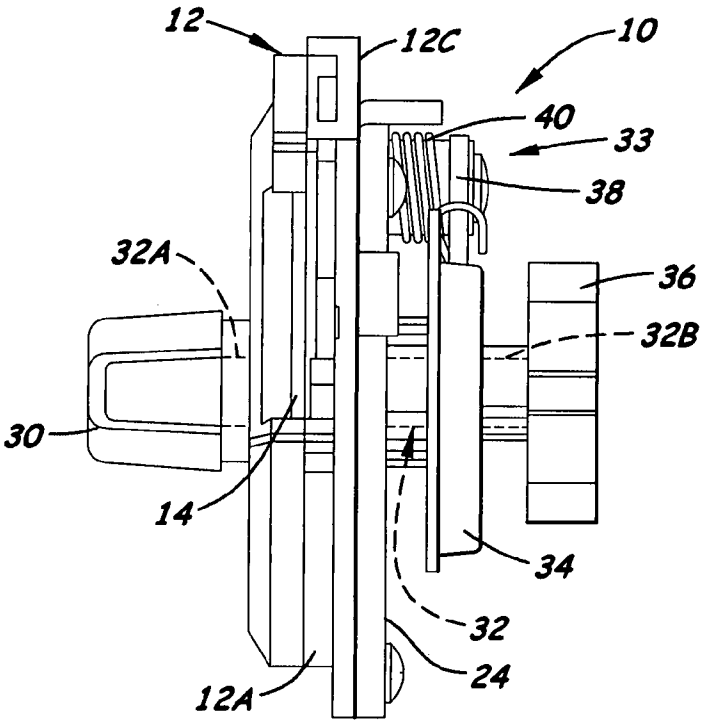
FIG. 2 is a right side elevational view of the actuation mechanism of FIG. 1.

Referring to the drawings and particularly to FIGS. 1 to 6, there is illustrated a multiple coin actuation mechanism, generally designated 10, of the present invention. It will be referred to hereinafter as the "improved" actuation mechanism 10. The improved actuation mechanism 10 retains the structural components of a prior art multiple coin actuation mechanism, as is substantially disclosed in U.S. Pat. No. 7,222,711, by the same inventor as herein. The improved actuation mechanism 10, however, introduces modifications in relationships between components of the prior art actuation mechanism which, though seeming small, achieve a relatively large improvement in the ease of operation of the improved actuation mechanism 10 over that of the prior art actuation mechanism. These modifications and the resulting improvement in ease of operation will become clear hereinafter. However, the structural components of the prior art actuation mechanism retained by improved actuation mechanism 10 will first be described.

The improved actuation mechanism 10 includes a front cover plate 12 adapted to be mounted and thus fixedly attached to a housing of a vending machine (not shown). The front cover plate 12 has a peripheral portion 12A and first and second coin slots 14, 16 defined in and open to the exterior of the plate 12 at the peripheral portion 12A thereof at locations angularly spaced apart from one another. The first and second coin slots 14, 16 also open into a recess 12B defined at the rear side 12C of the front cover plate 12 by its peripheral portion 12A.

Figure 4:
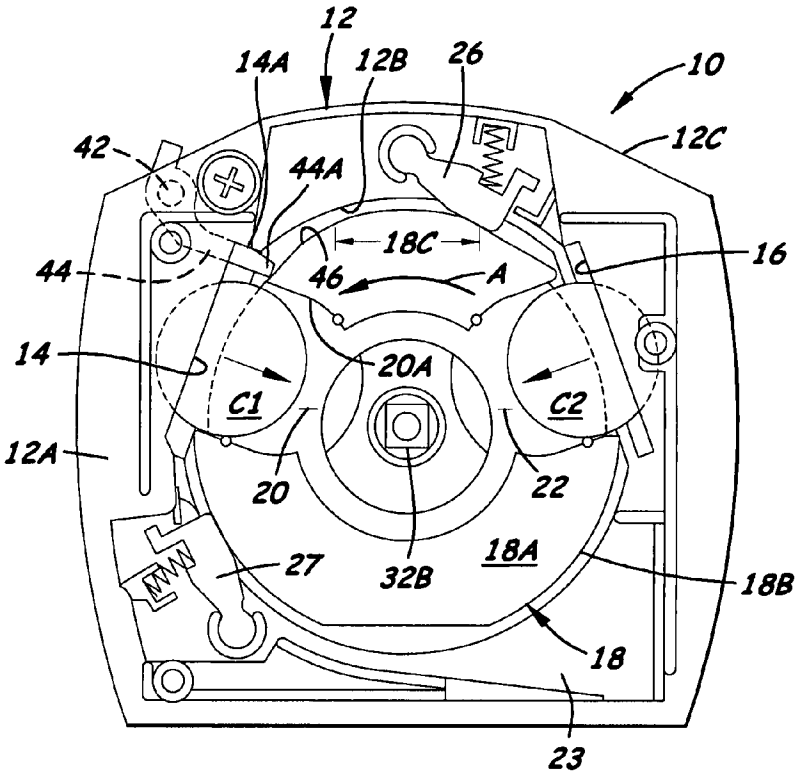
FIG. 4 is a rear elevational view of the actuation mechanism similar to that of FIG. 3 except with the rear retainer plate and one-way ratchet device removed to expose a rear side of a coin carrier wheel and now showing depositing of first and second coins through first and second coin slots in a front cover plate and into first and second coin recesses in the carrier wheel.
Figure 3:
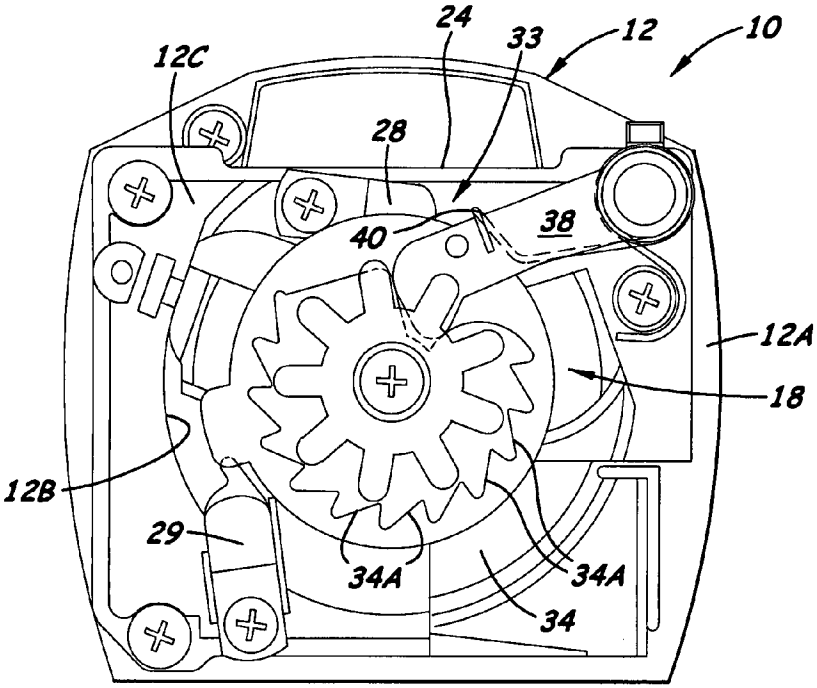
FIG. 3 is a rear elevational view of the actuation mechanism of FIG. 1.
Figure 5:
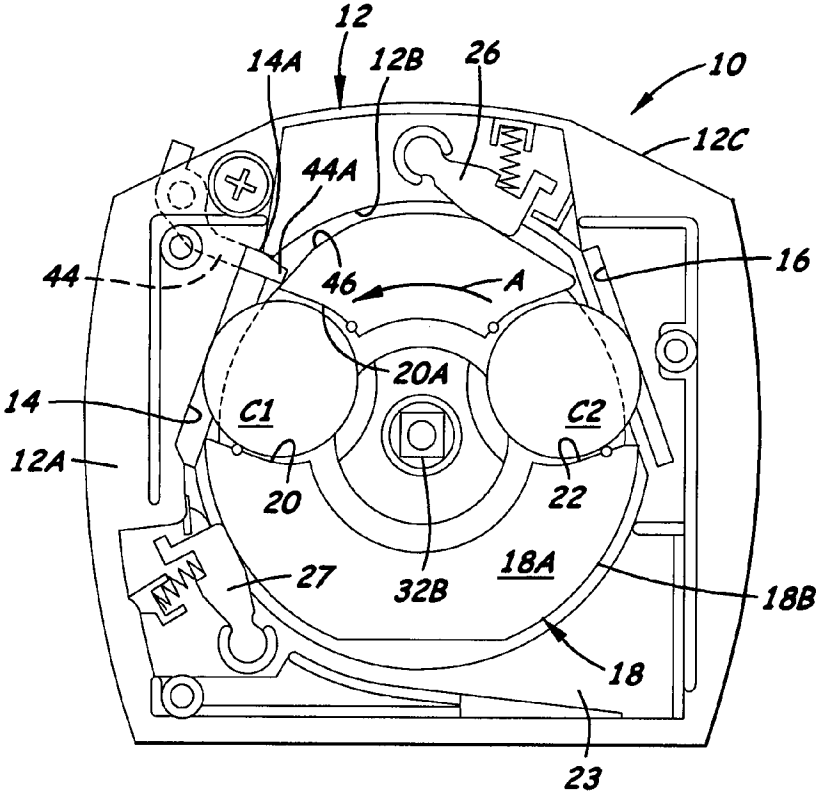
FIG. 5 is a rear elevational view similar to that of FIG. 4 but now showing the first and second coins resting in the first and second coin recesses of the carrier wheel.

The improved actuation mechanism 10 also includes a carrier wheel 18 mounted for rotation in a predetermined direction, as indicated by arrow A in FIG. 4, relative to the front cover plate 12 and within the rear recess 12B thereof. The carrier wheel 18 has a front side (not seen) facing toward the front cover plate 12 and a rear side 18A facing away from the front cover plate 12. The carrier wheel 18 also has a peripheral edge 18B and first and second coin recesses 20, 22 defined on the rear side 18A of the carrier wheel 18 at positions angularly spaced apart from one another. The first and second coin recesses 20, 22 of the carrier wheel 18 open at the peripheral edge 18B thereof and are aligned with the first and second coin slots 14, 16 of the cover plate 12 when the carrier wheel 18 is in an initial home position, as seen in FIGS. 4 and 5. With the carrier wheel 18 in such position, the user is enabled to deposit first and second coins C1, C2 through the first and second coin slots 14, 16 of the front cover plate 12 into the respective coin recesses 20, 22 of the carrier wheel 18, an operation that is shown in progress in FIG. 4 and after completion in FIG. 5. The carrier wheel 18 is rotatable from the initial home position of FIGS. 4 and 5 in the predetermined direction A past a final coin discharge location 23, as also seen in FIGS. 4 and 5 and in FIG. 6, before returning to the initial home position upon completion of a complete dispensing cycle of operation of the improved actuation mechanism 10.

The improved actuation mechanism 10 further includes a rear retainer plate 24 fixedly attached to the peripheral portion 12A of the front cover plate 12 at the rear side 12C thereof so as to overlying both the rear recess 12B of the front cover plate 12 and the carrier wheel 18 at the rear side 18A thereof. The rear retainer plate 24 assists the retention of the first and second coins C1, C2 in the first and second coin recesses 20, 22 of the carrier wheel 18 as the carrier wheel 18 is rotated in the predetermined direction A, which is counterclockwise as viewed in FIGS. 4-6, through the dispensing cycle of operation.

The improved actuation mechanism 10 still further has first and second pairs of spring-biased detents 26, 27 and 28, 29 mounted respectively to the front cover plate 12 and the rear retainer plate 24 for sensing the presence or absence of the correct first and second coins C1, C2 in the first and second coin recesses 20, 22 on the carrier wheel 18. Due to their spring bias, they will deflect so as to engage the carrier wheel 18 and become engaged with a corresponding one of the first and second coin recesses 20, 22 thereon should there be no coins in the corresponding one of the coin recesses 20, 22 or even if there is a coin present if it is not of the correct thickness or diameter. The detents 26-29 thus function to prevent rotation of the carrier wheel 18 in the predetermined direction A through a complete dispensing cycle unless the correct first and second coins C1, C2 have been deposited into the first and second coin recesses 20, 22.

The improved actuation mechanism 10 additionally includes a handle 30 and an elongate shaft 32 having the handle 30 fixed on its forward end 32A disposed adjacent to and exterior of the front cover plate 12. The shaft 30 extends from its forward end 32A through the front cover plate 12, carrier wheel 18 and rear retainer plate 24 to a rearward end 32B located rearwardly of the rear retainer plate 24.

Also, the improved actuation mechanism 10 has a one-way ratchet device 33 which includes a ratchet wheel 34 and a gear 36 fixedly mounted to the rearward end of the shaft 32. The handle 30 may be turned by a user to rotation the shaft 32 and the carrier wheel 18, ratchet wheel 34 and gear 36 therewith such that when the first and second coins C1, C2 have been deposited into the first and second coin recesses 20, 22 on the carrier wheel 18 the detents 26-29 will ride over the deposited coins C1, C2 and not engage in the coin recesses 20, 22. Such rotation of the carrier wheel 18 causes the deposited coins C1, C2 to exit the carrier wheel 18 at the final coin discharge location 23 into a coin collection box (not shown) and such rotation of the gear 36 actuates a dispensing mechanism (not shown) to cause an item to be dispensed from the vending machine to the user. Further, the one-way ratchet device 33 has a pawl 38 biased by a spring 40 and pivotally mounted to the rear retainer plate 24 adjacent to the ratchet wheel 34 so as to engage the ratchet wheel 34. The spring 40 so forcefully biases the pawl 38 toward the ratchet wheel 34 that the ratchet wheel 34 and the gear 36, shaft 32 and handle 30 therewith can only be turned in the one predetermined direction A once the pawl 38 has engaged in a leading one of the notches 34A in the row thereof defined in the ratchet wheel 34. Hence, it is understood now why the device 33 is called a one-way ratchet device.

Figure 1:
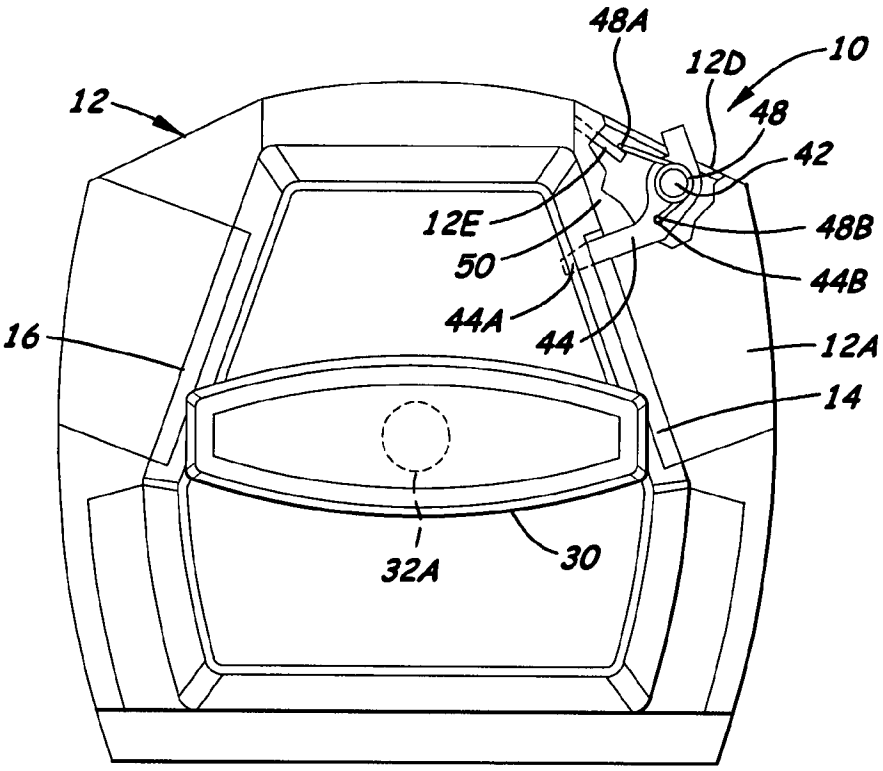
FIG. 1 is a front elevational view of a multiple coin actuation mechanism of the present invention.

Turning now to FIGS. 1 and 4-6, the improved actuation mechanism 10 further includes a mounting stud 42, a latch 44, an edge notch portion 46 and a coil spring 48. The mounting stud 42 is fixedly attached on and extends rearwardly from the rear side 12C of the front cover plate 12 radially outwardly from an upstream side 14A of the first coin slot 14 relative to the predetermined direction A of rotation of the carrier wheel 18. The latch 44 is pivotally mounted on the stud 42 for undergoing pivotal movement about the stud 42. The edge notch portion 46 is defined by a cutaway section of the peripheral edge 18B of the carrier wheel 18 adjacent to the upstream side 20A of the first coin recess 20 in the carrier wheel 18 relative to the predetermined direction A of rotation of the carrier wheel 18 so as to create a clearance sufficient in depth to position an inner end 44A of the latch 44 adjacent to the carrier plate 18 at the location of the edge notch portion 46 such that the latch 44 can assume a position in which the latch 44 points inwardly toward the carrier wheel 18 and extends alongside, but outside of, the path of insertion of the first coin C1 through the first coin slot 14 in the front cover plate 12, as seen in FIGS. 4 and 5. The coil spring 48 seats over and fits around the mounting stud 42 rearwardly of the latch 44 and has opposite ends 48A, 48B engaging and anchored to respective adjacent portions of the front cover plate 12 and the latch 44 so as place the coil spring 48 in a condition relative to the latch 44 in which it imposes a biasing force upon and thus holds the latch 44 toward and at a home position thereof (however, heretofore, the home position was not the same as the one shown in FIGS. 1 and 4-6). A cover 50, partially broken away as seen in FIG. 1, fits over and is fastened on the front cover plate 12 so as to retain the coil spring 48 in its desired condition on the stud 42. A stop ledge 12D is formed on the front cover plate 12 adjacent to but spaced from the stud 42 which limits the outward pivoting of the latch 44.

These same components as described above and their cooperative relationships per se are present in the prior art actuation mechanism and substantially shown in the cited patent (only the latch is shaped slightly differently in the cited patent than in the actual prior art actuation mechanism which is identical in shape to that of the latch 44 of the improved actuation mechanism 44). However, the difference reside in modifications introduced to relationships between the coil spring 48 and the latch 44. In the improved actuation mechanism 10, the coil spring 48 is now preset differently with respect to the latch 44 than the spring was in the cited patent and actual prior art actuation mechanism, which are basically the same. This change provides the latch 44 with a different home position and different pivotal movement and thus different blocking action with respect to the second coin C2 in the second coin recess 22 on the carrier wheel 18 than the latch had in the cited patent and actual prior art actuation mechanism.

Figure 6:
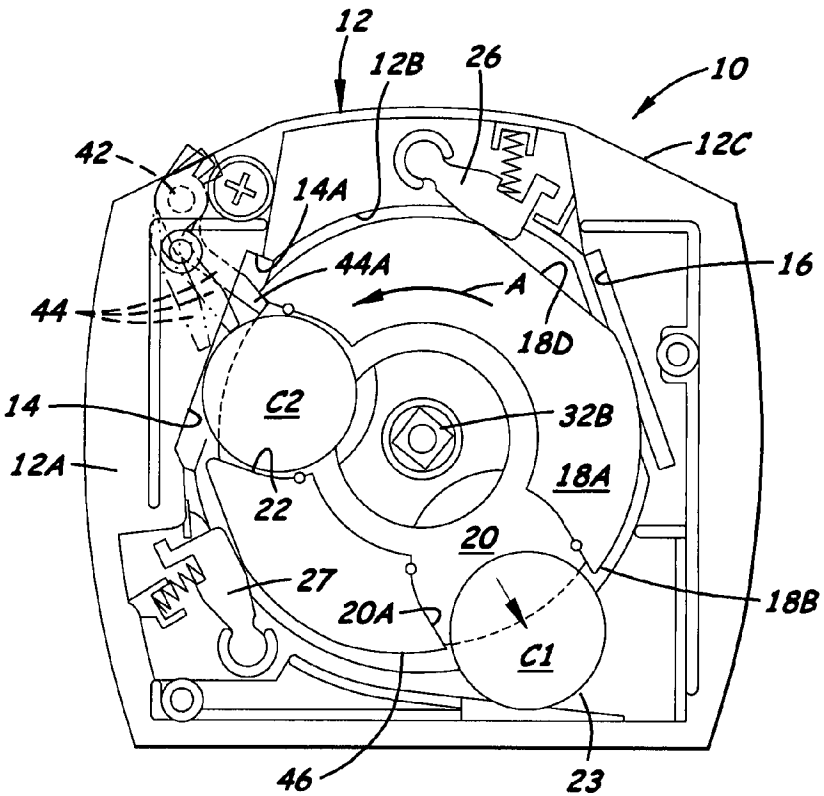
FIG. 6 is a rear elevational view similar to that of FIG. 5 but now showing the carrier wheel rotating in a counterclockwise direction such that the first coin has reached a discharge location as the second coin is passing the location of the first coin slot.

In other words, as specifically seen in FIG. 1, the anchor arrangement of the opposite ends 48A, 48B of the coin spring 48 against the outside of a fixed tab 12E on the front cover plate 12 and to a hole 44B in the latch 44 causes the coil spring 48 to assume a slightly expanded condition such that the biasing force it imparts on the latch 44 holds the latch 44 at an inner home or rest position, as seen in FIGS. 1, 4 and 5, in which the latch 44 points inwardly toward the carrier wheel 18 and the shaft 32 and extends through the upstream side 14A of the first coin slot 14 but substantially outside of the path of insertion of the first coin C1 through the first coin slot 14 in the front cover plate 12. The latch 44 will only undergo pivotal movement in a clockwise direction through a sequence of angularly displaced positions, as seen in FIG. 6, away from the inner home position, when forced to pivotally move due to contact by the peripheral edge 18B of the carrier wheel 18, at section 18C thereof, after the carrier wheel 18 has moved its edge notch portion 46 past the inner end 44A of the latch 44 and also when contacted by the second coin C2 residing in the second coin recess 22 on the carrier wheel 18 as it approaches the first coin slot 14.

As readily seen in FIGS. 1, 4 and 5, the result of the modification is that the latch 44 of the improved actuation mechanism 10 normally held by the coil spring 48 at the inner home position offers no obstruction or interfering-type contact to the user inserting the first coin C1 through the first coin slot 14 of the front cover plate 12 into the first coin recess 20 on the carrier wheel 18. The user is not even aware of the presence of the latch 44 and so the ease of operation of improved actuation mechanism 10 is greatly improved. Also, instead of blocking the first coin slot 14 as the second coin recess 22 becomes aligned with the first coin slot 14 as seen in FIG. 6, the latch 44 is only pivotally displaced clockwise in the predetermined direction A, by engagement with the second coin C2 in the second coin recess 22 as the carrier wheel 18 is rotated, through a distance sufficient to allow the second coin C2 in the second coin recess 22 to pass under it and for the latch 44 to ride over the second coin C2, to the position seen in FIG. 6. Upon the second coin C2 passing the latch 44, the latch 44 can then return to an intermediate position in which its inner end 44A extends into the space between the second coin C2 and the trailing edge 22A of the second coin recess 22 in which it obstructs any device inserted through the first coin slot 14 from dislodging the second coin C2 by reducing the width of the entrance to the second coin recess 22 and thus preventing exit of the second coin C2 out of the second coin recess 22. Thus, in all of its positions shown in FIG. 6 away from its initial home position, the latch 44 prevents removal of the second coin C2 from the second coin recess 22 on the carrier wheel 18 without actually directly needing to positively block access to the first coin slot 14 from the exterior of the front cover plate 12.

Only rotation of the carrier wheel 18 in the predetermined direction A away from its initial home position which moves the edge notch portion 46 of the carrier wheel 18 past the inner end 44A of the latch 44 and brings the peripheral edge 18B of the carrier wheel 18 and eventually the outer portion of the second coin C2 into interference and thus engagement with the inner end 44A of the latch 44, causes the latch 44 to pivot in the direction A against the biasing force of the coil spring 48, causing further expansion of the coil spring 48. As shown in FIG. 6, the latch 44 then pivotally moves through the sequence of angularly displaced positions in which its inner end 44A continues to engage the second coin C2 and to prevent its removal from the second coin recess 22 toward the first coin slot 14. Once the second coin C2 in the second coin recess 22 of the carrier wheel 18 has passed the latch 44 and a flat section 18D of the peripheral edge 18B has reached the latch 44, there is then sufficient clearance such that the coil spring 48 can contract and cause the latch 44 to then undergo pivotal movement in the opposite direction and return back to the initial inner home position seen in FIGS. 4 and 5. Contrary to the operation of these components in the prior art actuation mechanism, these same components in the improved actuation mechanism 10 thus comprise means for allowing unobstructed insertion of the first coin C1 inwardly through the first coin slot 14 of the front cover plate 12 into the first coin recess 20 of the carrier wheel 18. Also, these same components further comprise means for preventing removal of the second coin C2 from the second coin recess 22 of the carrier wheel 18 outwardly through the first coin slot 22 of the front cover plate 12 as the second coin recess 22 of the carrier wheel 18 is brought into alignment with the first coin slot 14 of the front cover plate 12 upon rotation of the carrier wheel 18 in the predetermined direction A through the complete dispensing cycle that results in the deposited first and second coins C1, C2 successively exiting from the carrier wheel 18 at the final coin discharge location 23.

To summarize, the difference resides in the different relationships between the coil spring 48 and the pivotal latch 44 and the different home position of the pivotal latch 44 as a result thereof. The coil spring 48 is now preset differently with respect to the latch 44 than in the cited patent. This change provides the latch 44 with a different home position and a different pivotal movement and thus different blocking action with respect to the second coin C2 in the second coin recess 22 on the carrier wheel 18. In other words, the anchoring arrangement of the opposite ends 48A, 48B of the coil spring 48 on the front cover plate 12 and the latch 42 and thus the biasing force it imparts on the latch 44 are different from that of the cited patent. The result is that the latch 44 in the improved actuation mechanism 10 offers no obstruction to the first coin C1 as it is inserted through the first coin slot 14 into the first coin recess 20 on the carrier wheel 18. Also, instead of blocking the first coin slot 14 as the second coin recess 22 becomes aligned with the first coin slot 14, the latch 44 is angularly displaced by engagement with the second coin C2 in the second coin recess 22 as the carrier wheel 18 is rotated in the direction A of movement of the second coin C2 on the carrier wheel 18 and thereby prevents removal of the second coin C2 from the second coin recess 22 on the carrier wheel 18 and does not actually directly block access to the first coin slot 14.

It should be realized that what is really involved in the changes or modifications that have been implemented here by the present invention is NOT a mere reversal of the functioning of the latch 44 by way of a reversal of the biasing force imposed by the coil spring 48 on the latch 44, even though generally speaking both before and after these changes or modifications, the first coin C1 can be inserted through the first coin slot 14 into the first coin recess 20 but the second coin C2 cannot be removed from the second coin recess 22 through the first coin slot 14. If it were a mere reversal of parts there would be no change in outcome. Such is not the case here. Here, the outcome is not the same either way: with the latch in an outer initial home position across the path of movement of the first coin C1 for its insertion through the first coin slot, as in the case of the actual prior art actuation mechanism and as disclosed in the cited patent, the latch is contacted by the first coin such that the latch has to be deflected out of the way by the first coin in order to achieve its insertion through the first coin slot. This obstruction is perceived by all users and in the case of some they become confused sufficiently that they might end up damaging the vending machine. On the other hand, in the improved actuation mechanism 10, the latch 44 in the inner home position, where it is disposed alongside but substantially outside of the path of movement of the first coin C1 for its insertion through the first coin slot 14, thus does not make obstructive or interfering-type contact with the first coin C1 when the first coin C1 is inserted through the first coin slot 14. While in the case of the prior art actuation mechanism where the user inserting the first coin will perceive and thus think that the latch is an obstruction that needs to be dealt with forcefully and may damage the vending machine by pushing the coin against the latch in an inappropriate way, by contrast thereto, when using the improved actuation mechanism 10, the user inserting the first coin C1 will not even realize that the latch 44 is present since the coin C1 makes no contact with the latch 44 as it is inserted through the first coin slot 14 and thus the user will not be motivated to take any inappropriate action that might cause damage to the vending machine. Thus, the change in the action of the coil spring 48 against the latch 44 which brings about the change in the initial position of the latch 46 does not amount to a mere reversal of the parts without any change in outcome since the change in the perception of the person inserting the coin which is accomplished is the intended outcome of the changes or modifications.

It is thought that the present invention and its advantages will be understood from the foregoing description and it will be apparent that various changes may be made thereto without departing from the spirit and scope of the invention or sacrificing all of its material advantages, the form hereinbefore described being merely a preferred or exemplary embodiment thereof.

The invention claimed is:

1. A multiple coin actuation mechanism for a vending machine, said mechanism comprising:

(a) a front cover plate adapted to fixedly attach to a vending machine, said front cover plate having a peripheral portion and first and second coin slots defined in and open at said peripheral portion at locations angularly spaced apart from one another;

(b) a carrier wheel mounted for rotation in a predetermined direction relative to said front cover plate and having a front side facing toward said front cover plate and a rear side facing away from said front cover plate, said carrier wheel also having a peripheral edge and first and second coin recesses defined on said rear side of said carrier wheel at positions angularly spaced apart from one another and open at said peripheral edge of said carrier wheel for alignment with said first and second coin slots of said cover plate when said carrier wheel is in an initial home position at which a user can initially deposit first and second coins into said first and second coin recesses through said first and second coin slots, said carrier wheel being rotatable from said initial home position in said predetermined direction past a final coin dispensing position before returning to said initial home position upon completion of a dispensing cycle of operation of said coin actuation mechanism;

(c) a rear retainer plate fixedly attached to said front cover plate and at least partially overlying said carrier wheel at said rear side thereof to assist retention of said first and second coins in said first and second coin recesses of said carrier wheel as said carrier wheel is rotated in said predetermined direction through said dispensing cycle of operation; and (d) means for allowing unobstructed insertion of said first coin through said first coin slot and into said first coin recess, said means including a latch biased to an inward home position in which an inner end of said latch extends through an upstream side of said first coin slot of said front cover plate, relative to said predetermined direction of rotation of said carrier wheel, generally alongside a path of insertion of said first coin through said first coin slot and into said first coin recess of said carrier wheel for allowing the unobstructed insertion of said first coin through said first coin slot into said first coin recess, said latch also pivotally yieldably movable away from said inward home position due to engagement with said second coin as said second coin recess of said carrier wheel is brought into alignment with said first coin slot of said front cover plate to allow said second coin in said second coin recess of said carrier wheel to pass under said latch and said latch to ride over said second coin while said latch remains in contact with said second coin and prevents removal of said second coin from said second coin recess of said carrier wheel as said carrier wheel is rotated in the predetermined direction through said complete dispensing cycle that results in the deposited first and second coins successively exiting from said carrier wheel at said final coin dispensing position.

2. The mechanism of claim 1 wherein said means for allowing unobstructed insertion of said first coin also includes a stud fixedly attached on and extending from said front cover plate at a location displaced radially outwardly from said upstream side of said first coin slot, said latch being pivotally mounted on said stud for undergoing pivotal movement between said inner home position and a sequence of angularly displaced positions displaced in said predetermined direction away from said inner home position.

3. The mechanism of claim 2 wherein said means for allowing unobstructed insertion of said first coin also includes an edge notch defined in said peripheral edge of said carrier wheel adjacent to an upstream side of said first coin recess in said carrier wheel relative to said predetermined direction of rotation of said carrier wheel so as to create a clearance sufficient to position said inner end of said latch adjacent to said carrier plate at the location of said edge notch such that said latch can assume said inner home position in which said latch inner end extends through said first coin slot and points toward said carrier wheel and extends alongside said path of insertion of said first coin through said first coin slot in said front cover plate so as to allow unobstructed initial insertion of said first coin past said latch and through said first coin slot into said first coin recess of said carrier wheel whereas once said carrier wheel has rotated in said predetermined direction away from said home position so as to move said edge notch past said inner end of said latch, said peripheral edge of said carrier wheel and also an outer portion of said second coin carried within said second coin recess of said carrier wheel, will interfere with and engage said inner end of said latch causing said latch to pivot in said predetermined direction of the carrier wheel and assume the sequence of angularly displaced positions so as to prevent removal of said second coin from said second coin recess and thus through said first coin slot as said second coin recess approaches alignment with and passes by said first coin slot.

4. The mechanism of claim 3 wherein said means for allowing unobstructed insertion of said first coin also includes a coil spring having opposite ends engaging respective adjacent portions of said front cover plate and said latch so as place said coil spring in a slightly expanded condition in which it imposes a biasing force upon and thus holds said latch toward and at said inner home position thereof such that when said carrier wheel is at said initial home position insertion of said first coin through said first coin slot is not obstructed by said latch in said inner home position whereas rotation of said coin wheel in said predetermined direction moves said edge notch of said carrier wheel past said inner end of said latch and brings said peripheral edge of said carrier wheel and eventually said outer portion of said second coin into interference and thus engagement with said inner end of said latch causing said latch to pivot against said biasing force of said coil spring, causing further expansion of said coil spring, through said sequence of angularly displaced positions in which said inner end of said latch engages said second coin and prevents removal of said second coin from said second coin recess toward said second coin slot, until said second coin and peripheral edge of said carrier wheel have passed said latch and said first coin slot at which time said coil spring contracts causing said latch to then pivotally return to said initial inner home position.

5. The mechanism of claim 1 further comprising:

a first detent movably mounted to said rear retainer plate and/or said front cover plate at a first location so as to engage said carrier wheel and to be successively engageable within said first and second coin recesses thereon to prevent continued rotation of said carrier wheel in said predetermined direction through said complete dispensing cycle unless said first and second coins have been deposited into said first and second coin recesses.

6. The mechanism of claim 5 further comprising:

a second detent movably mounted to said rear retainer plate and/or said front cover plate at a second location displaced from said first location of said first detent so as to engage said carrier wheel and to be successively engageable within said first and second coin recesses thereon to prevent continued rotation of said carrier wheel in said predetermined direction through the complete dispensing cycle unless said first and second coins have been deposited into said first and second coin recesses.

* * * * *